US012637278B2

(12) United States Patent
Maruyama

(10) Patent No.: US 12,637,278 B2
(45) Date of Patent: May 26, 2026

(54) PACKING MEMBER

(71) Applicant: KYOCERA Document Solutions Inc., Osaka (JP)

(72) Inventor: Kei Maruyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 46 days.

(21) Appl. No.: 19/008,290

(22) Filed: Jan. 2, 2025

(65) Prior Publication Data

US 2025/0223097 A1 Jul. 10, 2025

(30) Foreign Application Priority Data

Jan. 10, 2024 (JP) ..... 2024-001589

(51) Int. Cl.
*B65D 81/133* (2006.01)
*B65D 5/50* (2006.01)
*B65D 81/05* (2006.01)

(52) U.S. Cl.
CPC ..... *B65D 81/133* (2013.01); *B65D 5/505* (2013.01); *B65D 81/054* (2013.01)

(58) Field of Classification Search
CPC .... B65D 5/505; B65D 5/5021; B65D 5/5033; B65D 5/443; B65D 5/5054; B65D 5/5057; B65D 81/133; B65D 81/127; B65D 81/1275; B65D 85/68
USPC ..... 108/51.3, 56.3; 206/588, 521, 523, 592, 206/453, 320, 591; 217/52, 53; 229/104, 229/93
See application file for complete search history.

(56) References Cited

U.S. PATENT DOCUMENTS 1,613,152 A * 1/1927 Agar ..... B65D 5/5035 206/521
2,808,978 A * 10/1957 Wright ..... B65D 5/5071 206/320
3,072,313 A * 1/1963 Svendsen ..... B65D 81/054 206/320
3,957,196 A * 5/1976 Kellerman ..... B65D 5/5033 206/326
4,119,205 A * 10/1978 Delany ..... B65D 19/20 206/600
4,170,297 A * 10/1979 Johnson ..... B65D 85/62 206/326

(Continued)

FOREIGN PATENT DOCUMENTS

JP 2007-119008 A 5/2007

*Primary Examiner* — Gideon R Weinerth
(74) *Attorney, Agent, or Firm* — Stein IP, LLC

(57) ABSTRACT

A packing member includes a shock absorbing member and a base member. The base member has a first holding portion having a placement portion on which the shock absorbing member is placed, a first side portion, a top surface portion, and a second side portion. The second side portion has an engagement hole. The base member further has a second holding portion which protrudes upward from the side edge of the placement portion opposite from its side connecting to the first side portion. The second holding portion is disposed between the shock absorbing member and the second side portion, and has a base portion and a lock portion. The lock portion, by being folded at the boundary with the base portion, protrudes outward via the engagement hole, and engages with an edge of the engagement hole.

5 Claims, 10 Drawing Sheets

(56) References Cited

U.S. PATENT DOCUMENTS

| | | | | | |
|---|---|---|---|---|---|
| 4,247,289 | A * | 1/1981 | McCabe | B65D 5/505 | 206/521 |
| 4,248,350 | A * | 2/1981 | Gilbert | B65D 5/5033 | 206/320 |
| 4,863,024 | A * | 9/1989 | Booth | B65D 19/0016 | 206/386 |
| 5,595,125 | A * | 1/1997 | Bridges, Jr. | B65D 19/0012 | 108/51.3 |
| 5,921,187 | A * | 7/1999 | Wang | B65D 19/0016 | 108/56.3 |
| 6,357,364 | B1 * | 3/2002 | Maloney | B65D 19/0059 | 108/51.11 |
| 6,530,480 | B1 * | 3/2003 | Hardy | B65D 81/1275 | 206/523 |
| 7,344,029 | B2 * | 3/2008 | Sattora | B65D 5/5035 | 206/592 |
| 8,662,303 | B2 * | 3/2014 | Yoshida | B65D 5/509 | 206/521 |
| 11,490,746 | B2 * | 11/2022 | Veraza Osorio | A47B 96/1433 | |
| 2010/0187149 | A1 * | 7/2010 | Tsukii | B65D 5/5035 | 493/405 |
| 2012/0325719 | A1 * | 12/2012 | Jian | B65D 19/0002 | 206/521 |
| 2016/0039567 | A1 * | 2/2016 | Love | B65D 19/0097 | 108/51.3 |
| 2022/0315303 | A1 * | 10/2022 | Uyeda | B65D 5/5021 | |
| 2025/0223097 | A1 * | 7/2025 | Maruyama | B65D 81/133 | |

* cited by examiner

PACKING MEMBER

INCORPORATION BY REFERENCE

This application is based on and claims the benefit of priority from Japanese Patent Application No. 2024-001589 filed on Jan. 10, 2024, the contents of which are hereby incorporated by reference.

BACKGROUND

The present disclosure relates to a packing member.

Conventional packing members include a shock absorbing member and a base member. The shock absorbing member is bonded to the base member.

SUMMARY

According to one aspect of the present disclosure, a packing member includes a shock absorbing member and a base member. The base member holds the shock absorbing member. The base member is formed of a single sheet element. The base member has a first holding portion that has a placement portion on which the shock absorbing member is placed; a first side portion formed by cutting and raising a part of the base member so as to extend upward from a side edge of the placement portion along a first side surface of the shock absorbing member, the first side portion covering the first side surface; a top surface portion that is a part extending from a side edge of the first side portion opposite from its side connecting to the placement portion, the top surface portion, by being folded along the boundary with the first side portion, being disposed at a position opposite the placement portion across the shock absorbing member in a vertical direction, the top surface portion covering the shock absorbing member from above; and a second side portion that is a part extending from a side edge of the top surface portion opposite from its side connecting to the first side portion, the second side portion, by being folded along the boundary with the top surface portion, extending downward along a second side surface opposite from the first side surface of the shock absorbing member, the second side portion covering the second side surface. The second side portion has an engagement hole which penetrates the second side portion in a first direction, along which the first and second side portions are opposite each other across the shock absorbing member. The base member further has a second holding portion that is formed by cutting and raising a part of the base member so as to protrude upward from the side edge of the placement portion opposite from its side connecting to the first side portion. The second holding portion is disposed between the shock absorbing member and the second side portion along the first direction. The second holding portion has a base portion which is a part connecting to the placement portion, and a lock portion which extends upward from the base portion. The lock portion, by being folded at the boundary with the base portion, protrudes outward via the engagement hole from between the shock absorbing member and the second side portion along the first direction, and engages with an edge of the engagement hole.

DETAILED DESCRIPTION

Now, the description will be given on a packing member 100 according to one embodiment of the present disclosure with reference to FIGS. 1 to 10.

Figure 1:
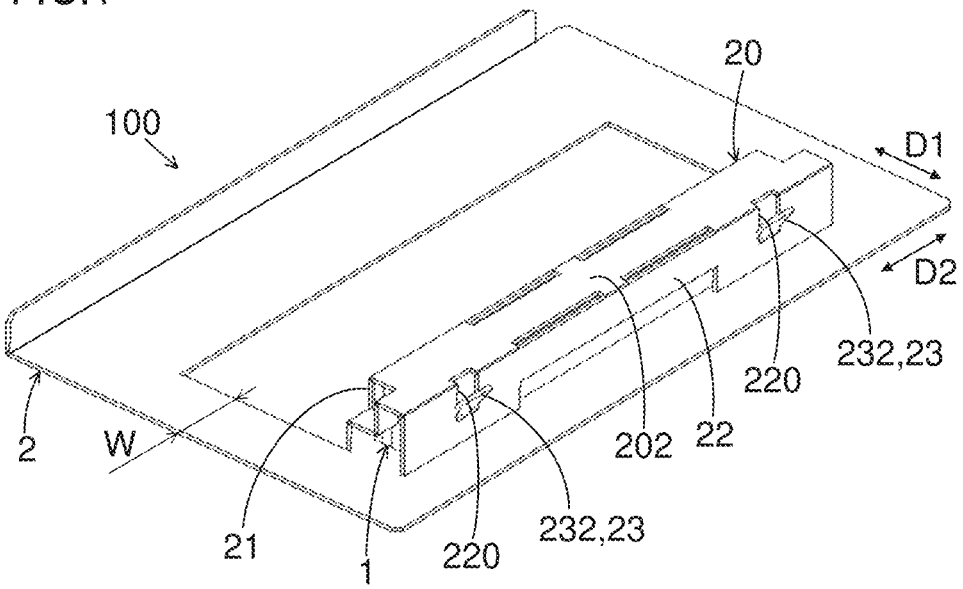
FIG. 1 is a perspective view of a packing member according to one embodiment.

Packing member: The packing member 100 according to the embodiment includes a shock absorbing member 1 and a base member 2 as shown in FIG. 1. The shock absorbing member 1 and the base member 2 combined together form the packing member 100. The packing member 100 is disposed, for example, on an inner surface of a packing case (not shown). The packing member 100 can be disposed on, of the inner surfaces of the packing case, the bottom surface or a side surface. The packing member 100 can also be disposed so as to cover a packed object (not shown) accommodated in the packing case from above.

Figure 2:
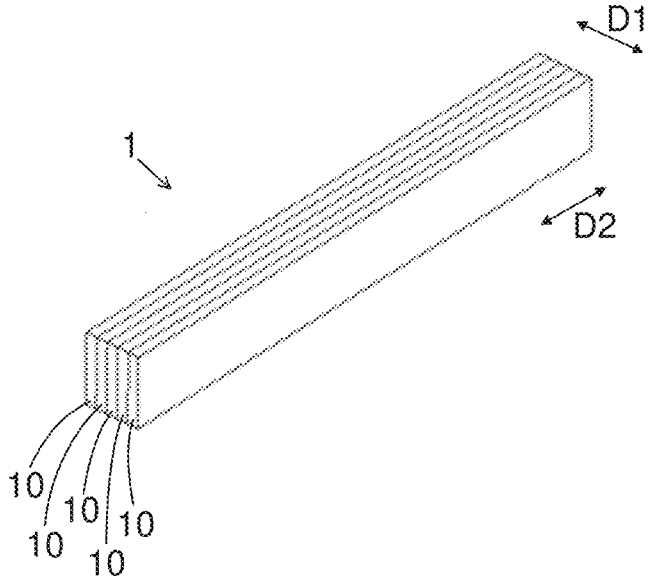
FIG. 2 is a perspective view of a shock absorbing member according to the embodiment.

Shock absorbing member: As shown in FIG. 2, the shock absorbing member 1 is a stack obtained by stacking together a plurality of shock absorbing sheet elements 10. The plurality of shock absorbing sheet elements 10, which can be cardboard sheets, are formed in a substantially rectangular shape as seen from the thickness direction of the shock absorbing sheet element 10. The plurality of shock absorbing sheet elements 10 are stacked together along the thickness direction of the shock absorbing sheet element 10. The shock absorbing member 1 absorbs shock applied along the stacking direction of the plurality of shock absorbing sheet elements 10 (i.e., the thickness direction of the shock absorbing sheet element 10). Accordingly, though not shown, with respect to the stack of the plurality of shock absorbing sheet elements 10 as the shock absorbing member 1, the packed object is arranged opposite the stack along its stacking direction. The shock absorbing member 1 can instead be formed by folding up a single sheet element.

Figure 3:
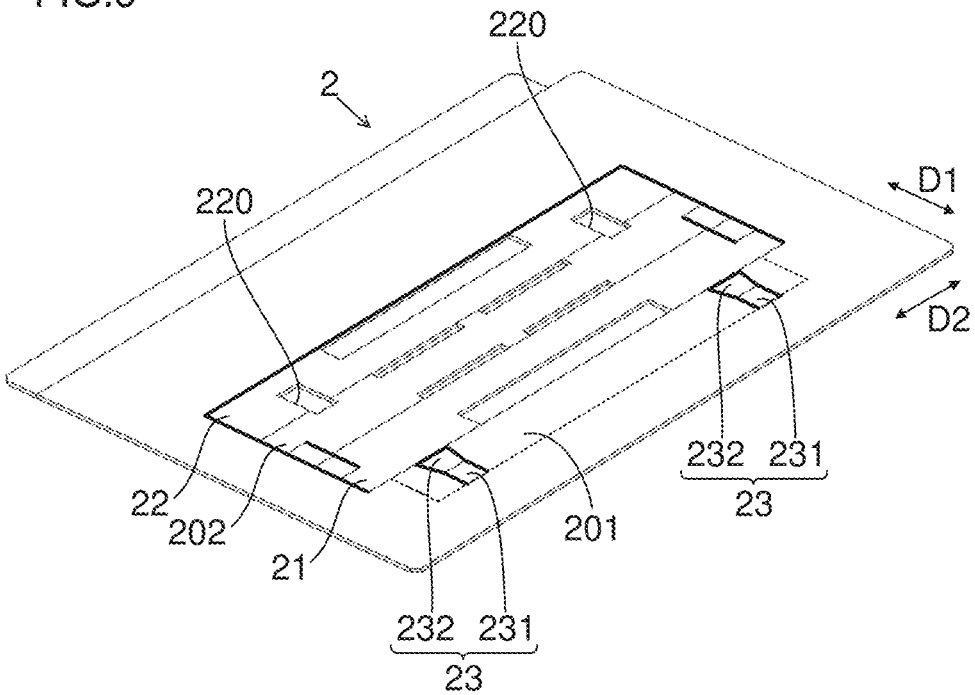
FIG. 3 is a perspective view (development view) of a base member according to the embodiment.

Base member: The base member 2 is formed by cutting and raising and then folding parts of a single sheet element as shown in FIG. 3. FIG. 3 is a development view of the base member 2. In FIG. 3, bold solid lines indicate cutting lines.

Note here that the base member 2 is not a combination of a plurality of different members. Thus, no adhesive or the like is needed to fasten together different members to form the base member 2. The sheet element forming the base member 2 is, for example, a cardboard sheet.

The base member 2 has a first holding portion 20 (see FIG. 4) for holding the shock absorbing member 1. Note that FIG. 4 corresponds to a section cut along line A-A' in FIG. 8. The base member 2 has a placement portion 201 for placing the shock absorbing member 1. The placement portion 201 has, as a placement surface, a part of the surface of the sheet element forming the base member 2. In FIG. 3, the area serving as the placement portion 201 is indicated by fine dashed lines.

In the following description, for convenience, the direction perpendicular to the placement surface of the placement portion 201 is defined as the vertical direction, and the side of the placement portion 201 on which the shock absorbing member 1 is placed is defined as the top side. This definition of the vertical direction is not meant as any limitation on the actual orientation or the positional relationship of any component in the packing member 100.

Moreover, in the following description, one direction perpendicular to the vertical direction is identified as D1 and is referred to as a first direction D1. Another direction perpendicular to the vertical direction and to the first direction D1 is identified as D2 and is referred to as a second direction D2. The first and second directions D1 and D2 are directions parallel to the placement surface of the placement portion 201.

The base member 2 has a substantially rectangular outer shape as seen from the vertical direction. Of the four sides of the base member 2, one pair of sides opposite each other extends along the first direction D1, and the other pair of sides opposite each other extends along the second direction D2.

With the shock absorbing member 1 placed on the placement portion 201, the stacking direction of the plurality of shock absorbing sheet elements 10 forming the shock absorbing member 1 is the same as the first direction D1, and the longitudinal direction of the shock absorbing member 1 is the same as the second direction D2. In the following description, of the shock absorbing member 1, the side surface pointing in one direction along the first direction D1 is referred to as a first side surface 11, and the side surface pointing in the other direction along the first direction D1 (i.e., the side surface opposite the first side surface 11) is referred to as a second side surface 12.

The placement portion 201 is a part of the base member 2 inward of an outer part of it as seen from the vertical direction. Note that, as seen from the vertical direction, the shock absorbing member 1 is substantially rectangular, with its longitudinal direction coinciding with the second direction D2. Thus, as seen from the vertical direction, the placement portion 201 is substantially rectangular, with its longitudinal direction coinciding with the second direction D2.

The base member 2 has a first side portion 21, a top surface portion 202, and a second side portion 22. The placement portion 201, the first side portion 21, the top surface portion 202, and the second side portion 22 together form the first holding portion 20. That is, the first holding portion 20 has the placement portion 201, the first side portion 21, the top surface portion 202, and the second side portion 22.

The first side portion 21, the top surface portion 202, and the second side portion 22 are cut and raised parts of the base member 2. By being cut and raised and then folded, they form a square tube together with the placement portion 201. Of the base member 2, the parts which are to become the first side portion 21, the top surface portion 202, and the second side portion 22 are cut and raised and then folded with the shock absorbing member 1 placed on the placement portion 201 (i.e., in the state shown in FIG. 6).

Figure 4:
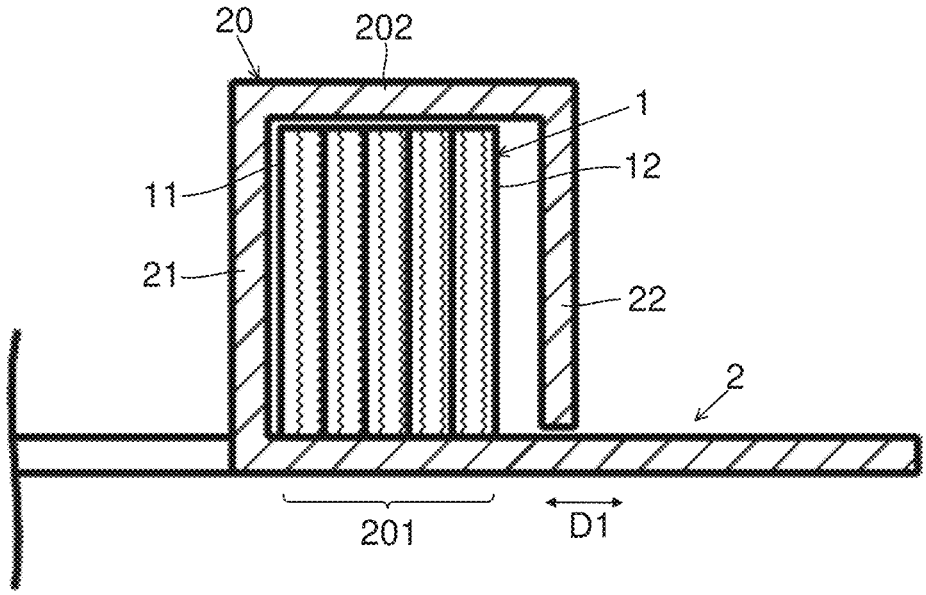
FIG. 4 shows a section (sectional view cut along the plane perpendicular to a second direction) of the shock absorbing member held by the base member along with its vicinity according to the embodiment.

Thus, as shown in FIG. 4, the shock absorbing member 1 is disposed inside the square tube formed by the placement portion 201, the first side portion 21, the top surface portion 202, and the second side portion 22. Disposing the shock absorbing member 1 inside the square tube results in the shock absorbing member 1 being held by the base member 2.

The first side portion 21 is formed by cutting and raising a part of the base member 2 so as to extend upward from the side edge of the placement portion 201 along the first side surface 11 of the shock absorbing member 1. The first side portion 21 covers the first side surface 11.

The top surface portion 202 is a part extending from the side edge of the first side portion 21 opposite from its side connecting to the placement portion 201. The boundary between the first side portion 21 and the top surface portion 202 (the line extending along the second direction D2) is a valley-fold line. The top surface portion 202, by being folded along the boundary with the first side portion 21, is placed at a position opposite the placement portion 201 across the shock absorbing member 1 in the vertical direction. In other words, the top surface portion 202, by being folded along the boundary with the first side portion 21, extends substantially parallel to the placement portion 201. The top surface portion 202 covers the shock absorbing member 1 from above.

The second side portion 22 is a part extending from the side edge of the top surface portion 202 opposite from its side connecting to the first side portion 21. The boundary between the top surface portion 202 and the second side portion 22 (the line extending along the second direction D2) is a valley-fold line. The second side portion 22, by being folded along the boundary with the top surface portion 202, extends downward along the second side surface 12 of the shock absorbing member 1. The second side portion 22 covers the second side surface 12. The first and second side portions 21 and 22 are opposite each other across the shock absorbing member 1 along the first direction D1.

Shape keeping structure: Simply cutting and raising a part of the base member 2 and then folding it into a square tube shape does not hamper the folded part from unfolding; it then cannot hold the shock absorbing member 1. To keep the folded part in a square tube shape, the base member 2 further has a second holding portion 23.

Figure 5:
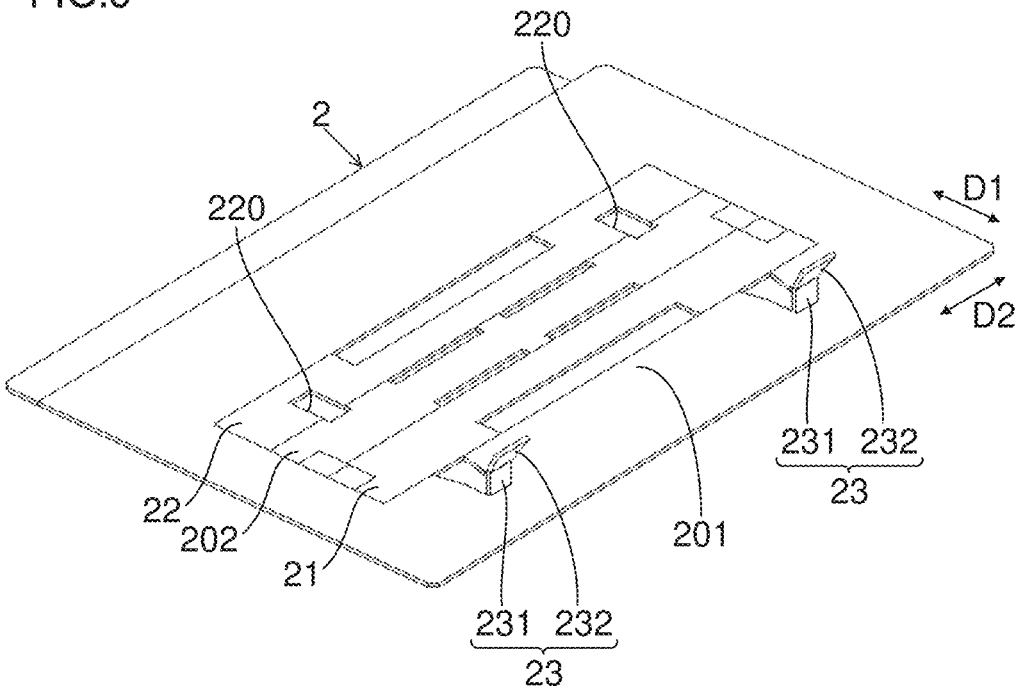
FIG. 5 is a perspective view of the base member shown in FIG. 3, with its holding portion cut and raised.
Figure 6:
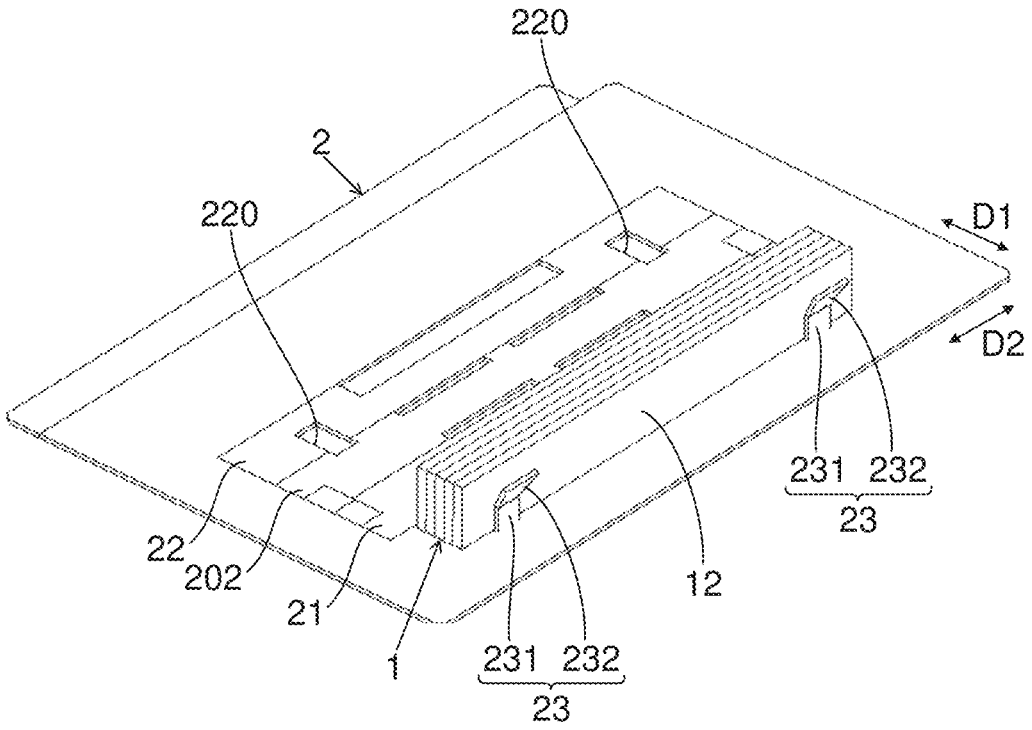
FIG. 6 is a perspective view of the base member shown in FIG. 5, with the shock absorbing member placed on it.

As shown in FIGS. 5 and 6, the second holding portion 23 is formed by cutting and raising a part of the base member 2 so as to protrude upward from the side edge of the placement portion 201 opposite from its side connecting to the first side portion 21. For example, the second holding portion 23 is formed by cutting and raising a part of the placement portion 201. The second holding portion 23 extends upward along the second side surface 12 of the shock absorbing member 1. The second holding portion 23 is disposed between the shock absorbing member 1 and the second side portion 22 along the first direction D1.

For example, to form the packing member 100, first, the second holding portion 23 is cut and raised (see FIG. 5). Next, the shock absorbing member 1 is placed on the placement portion 201 (see FIG. 6). Then, the parts which are to become the first side portion 21, the top surface portion 202, and the second side portion 22 are cut and raised and then folded. In this way, the second holding portion 23 can be disposed between the shock absorbing member 1 and the second side portion 22 along the first direction D1.

The second side portion 22 has an engagement hole 220, which penetrates the base member 2 in the thickness direction. With the parts which are to become the first side portion 21, the top surface portion 202, and the second side portion 22 cut and raised and then folded in a square tube shape, the engagement hole 220 is a hole penetrating the second side portion 22 in the first direction D1. The engagement hole 220 has a rectangular opening as seen from the first direction D1. For example, the engagement hole 220 stretches from the second side portion 22 to the top surface portion 202 crossing the boundary between the second side portion 22 and the top surface portion 202.

The second holding portion 23 has a base portion 231 and a lock portion 232. The base portion 231 is a part connecting to the placement portion 201. The lock portion 232 extends upward from the base portion 231. In other words, the lock portion 232 is a tip side part of the second holding portion 23. The lock portion 232 is folded at the boundary with the base portion 231.

Figure 7:
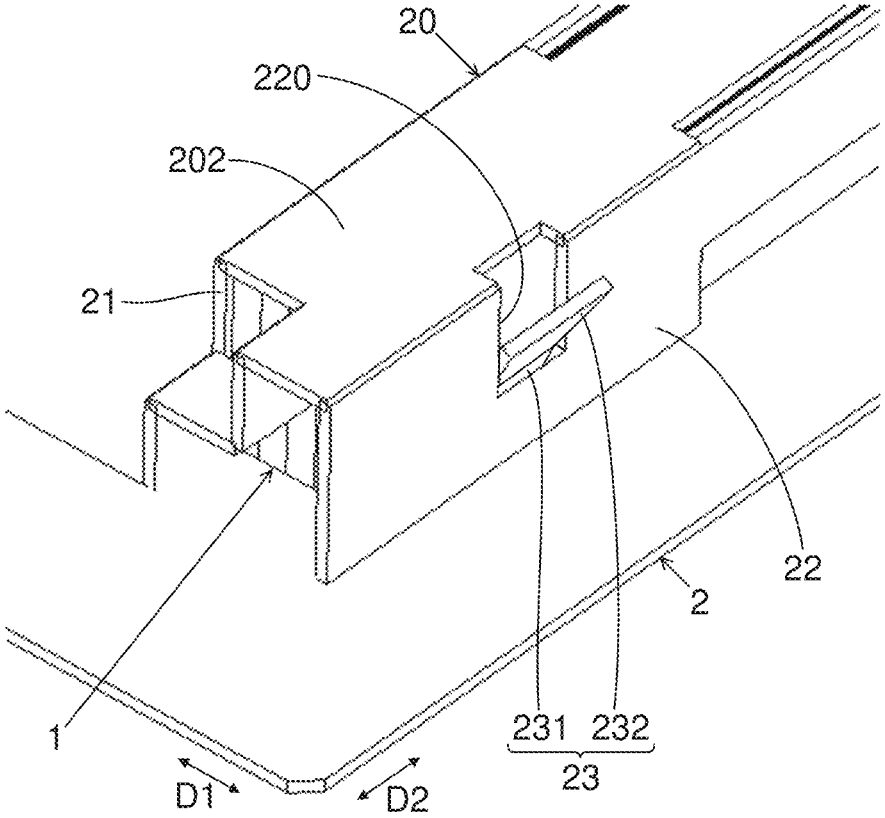
FIG. 7 is an enlarged perspective view of an engagement portion between an engagement hole and a lock portion of the base member along with their vicinity according to the embodiment.

Accordingly, as shown in FIG. 7, the lock portion 232 protrudes outward via the engagement hole 220 from between the shock absorbing member 1 and the second side portion 22 along the first direction D1. The lock portion 232 engages with a pair of edges of the engagement hole 220 that are opposite each other along the second direction D2. Engaging the lock portion 232 with the edges of the engagement hole 220 results in the first and second holding portions 20 and 23 being coupled together.

Figure 8:
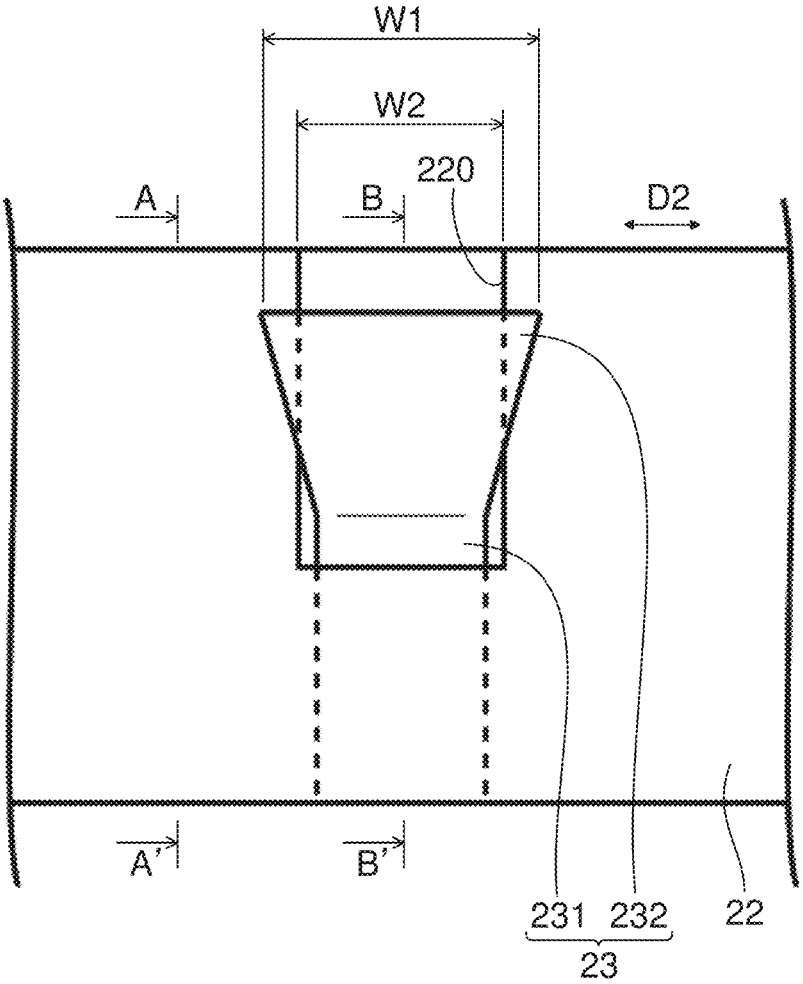
FIG. 8 is a plane view, as seen from a first direction, of the engagement portion between the engagement hole and the lock portion of the base member along with their vicinity according to the embodiment.

Here, as shown in FIG. 8, the lock portion 232 has a trapezoidal shape fanning out upward from the base portion 231 side as seen from the first direction D1. The width W1 of a tip part of the lock portion 232 (i.e., its part with the largest width along the second direction D2) is larger than the opening width W2 of the engagement hole 220 along the second direction D2. That is, the lock portion 232 has a part with a width along the second direction D2 larger than the opening width W2 of the engagement hole 220 along the second direction D2.

Owing to the lock portion 232 having a trapezoidal shape, the large width portion (i.e., tip portion) of the lock portion 232 contacts the edge of the engagement hole 220 from outside along the first direction D1. Owing to the maximum width W1 of the lock portion 232 being larger than the opening width W2 of the engagement hole 220, the lock portion 232 is unlikely to return to between the shock absorbing member 1 and the second side portion 22 along the first direction D1. That is, the engagement of the engagement hole 220 with the lock portion 232 is maintained. This prevents the unfolding of the part having the first side portion 21, the top surface portion 202, and the second side portion 22 (i.e., the part folded into a square tube shape).

Note that the longitudinal direction of the shock absorbing member 1 coincides with the second direction D2. To cover the shock absorbing member 1, the first side portion 21, the top surface portion 202, and the second side portion 22 also are elongate along the second direction D2.

The base member 2 thus has a plurality of second holding portions 23 disposed at intervals from each other along the second direction D2. Each of the plurality of second holding portions 23 has the base portion 231 and the lock portion 232. Accordingly, the second side portion 22 has a plurality of engagement holes 220 with which the plurality of lock portions 232 engage respectively. That is, the second side portion 22 has a plurality of engagement holes 220 disposed at intervals from each other along the second direction D2. This prevents the unfolding of the part having the first side portion 21, the top surface portion 202, and the second side portion 22 (i.e., the part folded into a square tube shape).

Figure 9:
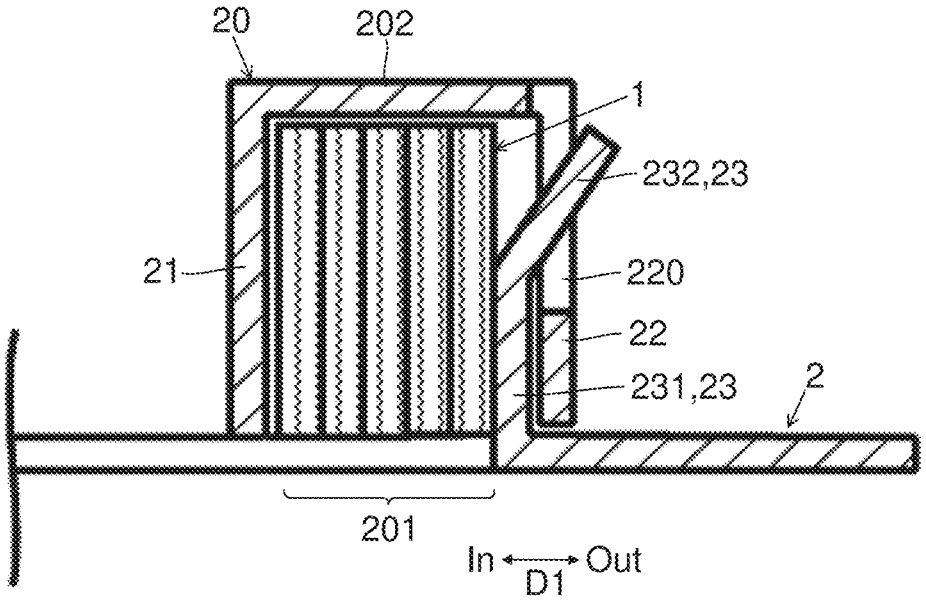
FIG. 9 is a sectional view (sectional view cut along the plane perpendicular to the second direction) of the engagement portion between the engagement hole and the lock portion of the base member along with their vicinity according to the embodiment.

In the embodiment, a part of the base member 2 is cut and raised as described above, and the cut and raised part is folded into a square tube shape so as to enfold the shock absorbing member 1. That is, the shock absorbing member 1 is disposed inside the part folded into the square tube shape (i.e., inside the square tube). Accordingly, the second holding portion 23 is disposed between the shock absorbing member 1 and the second side portion 22 along the first direction D1. Here, as shown in FIG. 9, pulling out the lock portion 232 from inward (In) to outward (Out) of the second side portion 22 along the first direction D1 permits the engagement hole 220 to engage with the lock portion 232. Note that FIG. 9 corresponds to a section cut along line B-B' in FIG. 8.

Figure 10:
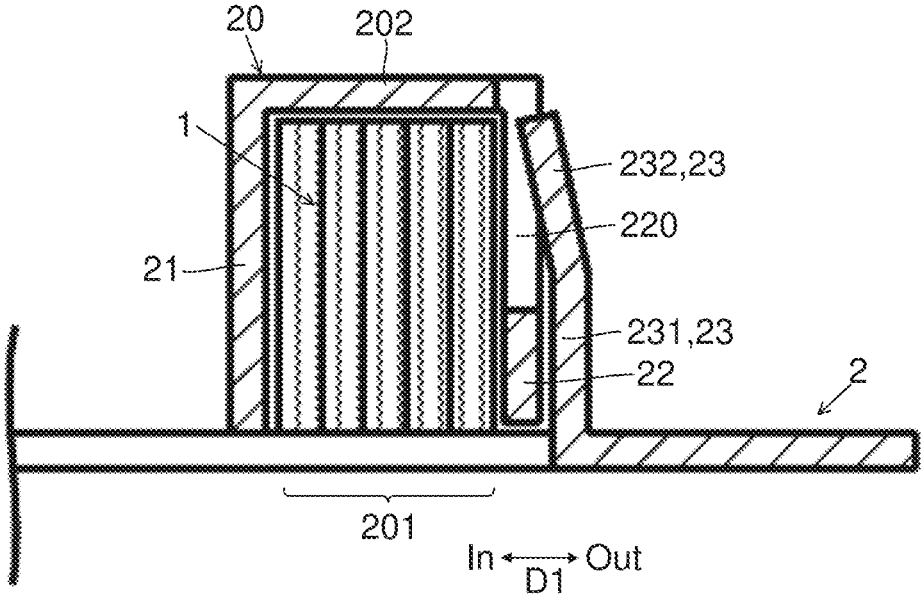
FIG. 10 is a sectional view illustrating a problem encountered when a second holding portion is disposed outward of a first holding portion.

For example, as shown in FIG. 10, in a case where the second holding portion 23 is disposed at the side of the second side portion 22 opposite from its side at which the shock absorbing member 1 is placed, to engage the lock portion 232 with the engagement hole 220, the lock portion 232 has to be pushed from outward (Out) to inward (In) of the second side portion 22 along the first direction D1. The shock absorbing member 1, however, lies inward along the first direction D1. Thus, the lock portion 232 cannot be pushed sufficiently in. Then, the engagement hole 220 and the lock portion 232 are engaged insufficiently. Or, the engagement hole 220 cannot be engaged with the lock portion 232.

For example, in the structure shown in FIG. 10, the first side portion 21, the top surface portion 202, and the second side portion 22 can be elongated in the second direction D2 with respect to the shock absorbing member 1 so that the engagement structure can be provided at both ends in the second direction D2. This, however, requires increasing the size of the base member 2 in the second direction D2, and makes the packing member 100 larger. If the size of the base member 2 in the second direction D2 is not increased, the width of the outer edge part of the base member 2 in the second direction D2 (the width W shown in FIG. 1) is so small that the base member 2 itself bends easily.

Elongating the first side portion 21, the top surface portion 202, and the second side portion 22 in the second direction D2 reduces their rigidity of the first side portion 21, the top surface portion 202, and the second side portion 22. Increasing the rigidity of these portions requires measures such as giving them a curved shape. This complicates the structure and increases the cost.

By contrast, the embodiment does not require elongation of the first side portion 21, the top surface portion 202, and the second side portion 22 in the second direction D2, and thus does not require additional measure for increasing the rigidity of these portions. Moreover, the base member 2 itself does not lose its rigidity. Thus, with the embodiment, the base member 2 can hold the shock absorbing member 1 easily without decreasing the rigidity of the base member 2.

The embodiment disclosed herein should be understood to be merely illustrative and not restrictive. The scope of the present disclosure is set forth in the appended claims, and not in the above description of the embodiment. The scope of the present invention encompasses any modifications within the meaning and scope equivalent to the claims.

What is claimed is:

1. A packing member comprising:

a shock absorbing member; and a base member that holds the shock absorbing member, wherein the base member is formed of a single sheet element, the base member has a first holding portion that has:

a placement portion on which the shock absorbing member is placed;

a first side portion formed by cutting and raising a part of the base member so as to extend upward from a side edge of the placement portion along a first side surface of the shock absorbing member, the first side portion covering the first side surface;

a top surface portion that is a part extending from a side edge of the first side portion opposite from a side thereof connecting to the placement portion, the top surface portion, by being folded along a boundary with the first side portion, being disposed at a position opposite the placement portion across the shock absorbing member in a vertical direction, the top surface portion covering the shock absorbing member from above; and a second side portion that is a part extending from a side edge of the top surface portion opposite from a side thereof connecting to the first side portion, the second side portion, by being folded along a boundary with the top surface portion, extending downward along a second side surface opposite from the first side surface of the shock absorbing member, the second side portion covering the second side surface, the second side portion has an engagement hole which penetrates the second side portion in a first direction, along which the first and second side portions are opposite each other across the shock absorbing member, the base member further has a second holding portion that is formed by cutting and raising a part of the base member so as to protrude upward from the side edge of the placement portion opposite from a side thereof connecting to the first side portion, the second holding portion is disposed between the shock absorbing member and the second side portion along the first direction, the second holding portion has:

a base portion which is a part connecting to the placement portion; and a lock portion which extends upward from the base portion, and the lock portion, by being folded at a boundary with the base portion, protrudes outward via the engagement hole from between the shock absorbing member and the second side portion along the first direction, the lock portion engaging with an edge of the engagement hole.

2. The packing member according to the claim 1, wherein the lock portion has a part of which a width along a second direction perpendicular to both the first direction and the vertical direction is larger than an opening width of the engagement hole along the second direction.

3. The packing member according to the claim 2, wherein the lock portion has a trapezoidal shape fanning out upward from a base portion side as seen from the first direction.

4. The packing member according to the claim 1, wherein the shock absorbing member is a member of which a longitudinal direction coincides with a second direction perpendicular to both the first direction and the vertical direction, the base member has a plurality of the second holding portions disposed at intervals from each other along the second direction, the plurality of the second holding portions each have the base portion and the lock portion, and the second side portion has a plurality of the engagement holes with which the plurality of the lock portions engage respectively.

5. The packing member according to the claim 1, wherein the shock absorbing member is formed by stacking together a plurality of shock absorbing sheet elements.

* * * * *